US006023446A

United States Patent [19]

Farine et al.

[11] Patent Number: 6,023,446

[45] Date of Patent: Feb. 8, 2000

[54] TIMEPIECE COMPRISING A GENERATOR DRIVEN BY THE MAIN SPRING OF A BARREL

[75] Inventors: Pierre-André Farine, Neuchâtel; Jean-Jacques Born, Morges, both of Switzerland

[73] Assignee: Asulab S.A., Bienne, Switzerland

[21] Appl. No.: 09/236,226

[22] Filed: Jan. 22, 1999

[30] Foreign Application Priority Data

Feb. 5, 1998 [CH] Switzerland ..... 0283/98

[51] Int. Cl.[7] ..... G04B 1/00; G04B 5/02; G04C 3/00

[52] U.S. Cl. ..... 368/204; 368/208

[58] Field of Search ..... 368/64, 203–204, 368/206–208

[56] References Cited

U.S. PATENT DOCUMENTS 3,715,880 2/1973 Simons ..... 368/204
4,799,003 1/1989 Tu et al. ..... 322/29
5,668,414 9/1997 Takahashi et al. .
5,923,619 7/1999 Knapen ..... 368/64

FOREIGN PATENT DOCUMENTS 686 332G A3 3/1996 Switzerland .

*Primary Examiner*—Vit Miska
*Attorney, Agent, or Firm*—Griffin, Butler, Whisenhunt & Szipl, LLP

[57] ABSTRACT

A timepiece comprising a generator (1) for generating a supply voltage of a first predetermined value $U_1$, a barrel with a spring (5, 6), a winding mechanism (5') and a set of hands (7 to 9). The electronic circuit (11, 12) of the timepiece requires a minimum limited supply voltage having a second predetermined value $U_2$. This circuit comprises a timebase (12) and a regulating circuit (11) for regulating the rotational speed of the generator. According to the invention, a voltage regulator (25) is connected between the generator and said electronic circuit for adjusting its output voltage to said limited second value $U_2$. The ratio between the absolute value $\hat{U}_1$ of the predetermined first value $U_1$ and the second predetermined value satisfies the relationship $\hat{U}_1=k\cdot U_2$, k being a factor corresponding at least to the maximum expected variation rate of the absolute value $\hat{U}_1$ when the timepiece is worn.

4 Claims, 1 Drawing Sheet

TIMEPIECE COMPRISING A GENERATOR DRIVEN BY THE MAIN SPRING OF A BARREL

Figure 1:
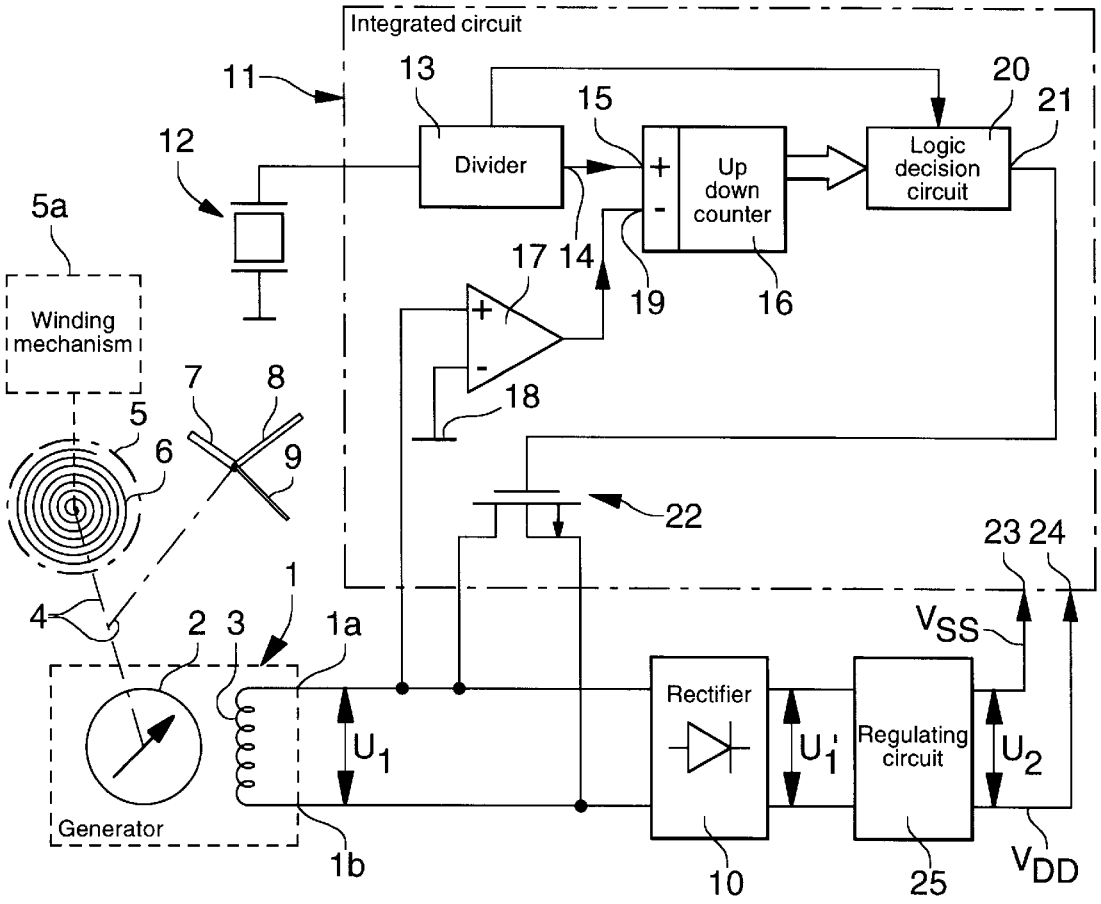

The present invention concerns an electronic timepiece of the type comprising an energy source formed of a barrel spring, which may be manually or automatically wound, coupled to an alternating current generator intended to power the electronic circuit of the timepiece, possibly via a rectifier.

A description of such a timepiece is given in the Swiss Patent CH 686 332, this document being directed particularly to a regulating circuit allowing to slave the rotational speed of the generator to a reference speed which corresponds to the correct running of the timepiece, in so far that the energy of the barrel spring is sufficient to maintain this rotational speed at the reference speed.

The regulating circuit functions in the following manner. During the normal running period, the generator which is coupled directly to the barrel has the tendency to rotate too fast and to thus supply a voltage having a frequency higher than a reference value of the frequency derived from a frequency standard functioning on the basis of a horologic quartz. It is thus necessary to brake the generator, which is realized by short-circuiting periodically its inductance winding. The number of times that braking is necessary to maintain the generator at the nominal speed is high when the spring is fully wound and progressively decreases when the energy accumulated in the spring dies out.

The regulating circuit is realized in such a way that it may function with a low supply voltage, which is preferably obtained thanks to the CMOS technology. Its energy consumption depends almost linearly on the voltage which is applied to the circuit, as long as this voltage is sufficient to allow the functioning on the components of the circuit. Indeed, if the supply voltage drops below a critical value, the circuit stops functioning. It is thus true that from the point of view of low consumption, which is preferable to ensure a large autonomy of the timepiece when it is not worn, it would be advantageous to operate the regulating circuit at a limit voltage which is as close as possible to the critical voltage but which is however sufficient for the watch to function correctly.

However, if the timepiece is conceived in this manner, or in other words if the limit voltage is chosen too close to this critical voltage, there is a risk that the watch will undergo major functional defaults (and will thus not indicate the correct time), because the voltage of the generator supplying the regulating circuit may be subject to important variations due to rotational speed variations of the generator. These latter variations may be provoked by any exterior factor depending on the way in which the timepiece is worn. For example, the rotational speed of the generator may vary in case of more or less violent shocks, or abrupt movements of the wearer, etc. If such a disturbing factor goes against the maintaining of the nominal rotational speed, there is a risk that the supply voltage may drop below the critical value. Thus irregularities in the running of the timepiece would be unavoidable.

The invention thus has its aim to provide a timepiece which may function with a regulating circuit supplied with a supply voltage situated substantially near the limited value necessary for its correct functioning, but in such a way that the running of the timepiece is not disrupted by possible rotational irregularities of the generator.

This invention thus has as an object an electronic timepiece comprising:

a generator for generating a supply voltage of a first predetermined value $U_1$;

a barrel with a spring coupled to and driving said generator;

a winding mechanism coupled to said barrel for winding the spring;

a set of time indicating hands also driven by said barrel, and an electronic circuit which requires for its operation at least a lower limited supply voltage having a second predetermined value $U_2$, said electronic circuit comprising a timebase and a regulating circuit for regulating the rotational speed of said generator so that said set of hands is driven at the nominal speed indicating the correct time, said timepiece being characterized in that it further comprises a voltage regulator connected between said generator and said electronic circuit and capable of adjusting its output voltage to said second limited value $U_2$ or slightly above this value, and in that the ratio between the absolute value $\hat{U}_1$ of said first predetermined value $U_1$ and said second predetermined value $U_2$ satisfies the relationship $\hat{U}_1=k\cdot U_2$ in which k is a factor corresponding at least to the maximum expected variation rate of said absolute value $\hat{U}_1$ when said timepiece is worn.

It follows from these features that the electronic circuit of the timepiece receives a supply voltage which is sufficient to avoid interruption of the functioning despite kinetic influences acting on the mechanical components of the timepiece when it is worn.

Other features and advantages of the present invention will appear more clearly upon reading the following description, which is made by way of a non-limiting example only and in which reference is made to the annexed drawings, in which:

the sole FIGURE shows a simplified block diagram of an example of the timepiece according to the invention.

Reference will now be made to the only figure in which it can be seen that the timepiece according to the invention comprises a generator symbolized by rectangle 1 comprising a magnetic rotor 2 and at least one winding 3. The rotor is coupled mechanically, for example via a wheel-train 4 symbolized by dotted lines, to a barrel 5 in which is located a spring 6. This spring may be wound by a known winding mechanism, which is either manual or automatic, and which is symbolized by rectangle 5*a*. Wheel-train 4 is also coupled to a set of time indicating hands formed here of an hour hand 7, a minute hand 8 and a second hand 9. The hands are coupled to each other in the usual manner with the appropriate demultiplying ratios, and are rigidly connected to the rotor of generator 1. Due to this, these hands turn as long as rotor 2 moves.

In the shown example, generator 1 provides an alternating nominal voltage of a first predetermined value $U_1$ at its terminals 1*a* and 1*b* and at a predetermined frequency, for example 21.3 Hz. The maximal, or absolute value $\hat{U}_1$ of the predetermined value $U_1$ may correspond to a maximum amplitude of for example 1.5 volts.

It should be noted that the invention is not limited to a generator providing an alternating voltage, because a generator providing a continuous voltage may also be used.

In the present example, generator 1 is of the alternating type and is connected to a full wave rectifier providing a continuous voltage $U_1'$ having a value which is slightly less than the value of the alternating voltage of the generator, the difference being determined by losses, which usually are low, provoked by rectifier 10.

The timepiece also comprises a quartz oscillator 12 associated with an integrated circuit 11 having several components forming a regulating circuit of the rotational speed of generator 1. Standard frequency quartz oscillator 12 provides a pulse signal, for example at a frequency of 32'768 Hz, to a frequency divider 13 of integrated circuit 11, this divider may be obtained for example by way of an EEPROM circuit. It comprises a terminal 14 providing a signal having a frequency which corresponds to the nomainal frequency which the generator 1 should provide so that hands 7, 8 and 9 indicate the correct running time. In the described example, this nominal frequency is 21.3 Hz. The output 14 is connected to the up-counting input 15 of an up-down counter 16.

Terminal 1*a* of generator 1 is connected to one of the inputs of a comparator 17, the other input of which is connected to a reference voltage source 18 for example the ground. The output of comparator 17 is connected to the down-counting input 19 of up-down counter 16.

Comparator 17 provides an output pulse to the up-down counter when the voltage of terminal 1*a* of the generator rises slightly above the ground potential. As a consequence, and considering that in the present example the generator 1 rotates exactly at the nominal speed corresponding to a frequency of 21.3 Hz, the contents of up-down counter 16 should be equal to zero at the end of each alternance of the output voltage of generator 1.

The output of the up-down counter 16 is connected to a logic decision circuit 20 which, as a function of certain predetermined conditions, provides an output signal to an output terminal 21, the conditions being materialized by cabling a certain number of elementary gates which compose this logic decision circuit.

The signal present at output terminal 21 is applied to the control electrode of a switching component 22 which selectively controls the braking of generator 1 by short-circuiting the winding 3 of this generator. This switching component 22 may be a MOS transistor having its source-drain circuit connected between the terminals 1*a* and 1*b* of generator 1.

Integrated circuit 11 comprises supply terminals 23 and 24 which are respectively applied with a voltage $V_{SS}$ and with the voltage $V_{DD}$ of the integrated circuit.

It should be noted that the particularities of the regulating circuit mentioned hereabove, are only described to recall a particular embodiment forming the object of European Patent Application EP 97 112 585.1 in the name of the present assignee. However, the present invention may also be advantageously carried out with different types of regulating circuits which assure the regulation of the running of the timepiece. It should however be noted that integrated circuit 11 is a low consumption circuit, i.e. it functions with a supply voltage which is much less than that of the absolute value $\hat{U}_1$ of the nominal voltage $U_1$ provided by generator 1.

According to the invention, supply terminals 23 and 24 are connected to the output of a voltage regulator 25. This regulator is conceived to provide at its output terminals the regulated voltage having a second predetermined value $U_2$. This value of the voltage corresponds to or is slightly more than the lower limit voltage, or critical voltage, which integrated circuit 11 needs to still operate correctly. Preferably, output voltage $U_2$ of the voltage regulator is chosen between 0% and 5% above, or preferably between 2% and 5% above the limit operating voltage of integrated circuit 11.

The continuous output voltage $U_2$ of regulator 25 is much less than the maximum or absolute value $\hat{U}_1$ of the alternating voltage $U_1$ provided by the generator 1. The relationship between the values $\hat{U}_1$ and $U_2$ may thus be described by $\hat{U}_1=k\cdot U_2$ in which k is a factor corresponding to at least a maximum expected variation rate of the nominal voltage $\hat{U}_1$ of the generator, when the generator functions in a non-braking state, when wearing the timepiece. The variation rate means here such rate will only change with fluctuations which undergoes voltage $\hat{U}_1$ due to rotation irregularities of the generator which axe due to mechanical phenomena acting on the timepiece when worn. As such, voltage regulator 25 is then capable of smoothing out any fluctuation present at its input compared to integrated circuit 11 which thus always will have a voltage available which is at least equal to the lower limit value which it needs to operate correctly. In a practical example, it is thus noted that the variation rate of the nominal voltage of the generator may be 20% when the watch is worn, so that the factor k should be preferably at least equal to 1.2.

As an indication and by way of example only, the following values of voltages may be chosen:

$$\hat{U}_1=1.5\text{ V},\ U_2=1\text{ V}$$

The voltage regulator may be of any appropriate type obtained by low consumption CMOS technology.

It should be understood that the present invention is not limited to the described and represented embodiment which is only given by way of example.

What is claimed is:

1. An electronic timepiece comprising:

a generator for generating a supply voltage of a first predetermined value $U_1$;

a barrel with a spring coupled to and driving said generator;

a winding mechanism coupled to said barrel for finding the spring;

a set of time indicating hands also driven by said barrel, and an electronic circuit which requires for its operation at least a lower limited supply voltage having a second predetermined value $U_2$, said electronic circuit comprising a timebase and a regulating circuit for regulating the rotational speed of said generator so that said set of hands is driven at the nominal speed indicating the correct time, wherein said timepiece further comprises a voltage regulator connected between said generator and said electronic circuit and capable of adjusting its output voltage to said second limited value $U_2$ or slightly above this value, and wherein the ratio between the absolute value $\hat{U}_1$ of said first predetermined value $U_1$ and said second predetermined value U2 satisfies the relationship $\hat{U}_1=k\cdot U_2$, in which k is a factor corresponding at least to the maximum expected variation rate of said absolute value $\hat{U}_1$ when said timepiece is worn.

2. A timepiece according to claim 1, wherein the factor k is located between 1.2 and 1.5.

3. A timepiece according to claims 1 wherein said second predetermined value $U_2$ is 0 to 5% more, and preferably 2 to 5% more than the lower limited voltage at which said electronic circuit can still function.

4. A timepiece according to claim 2, wherein said second predetermined value $U_2$ is 0 to 5% more, and preferably 2 to 5% more than the lower limited voltage at which said electronic circuit can still function.

* * * * *